United States Patent [19]

Stockel

[11] Patent Number: 4,962,886

[45] Date of Patent: Oct. 16, 1990

[54] HIGH FLOW RATE NOZZLE SYSTEM WITH PRODUCTION OF UNIFORM SIZE DROPLETS

[75] Inventor: Ivar H. Stockel, Bangor, Me.

[73] Assignee: The Board of Trustees of the University of Maine, Bangor, Me.

[21] Appl. No.: 258,203

[22] Filed: Oct. 14, 1988

[51] Int. Cl.[5] ..... B05B 1/08; B05B 7/08; B05B 7/10

[52] U.S. Cl. ..... 239/11; 239/99; 239/101; 239/380; 239/413; 239/543

[58] Field of Search ..... 239/93, 97, 11, 1, 214, 239/223, 380, 543, 101, 99, 412, 413, 433; 137/624.13

[56] References Cited

U.S. PATENT DOCUMENTS

| | | | |
|---|---|---|---|
| 1,130,194 | 3/1915 | Papillon | 239/523 X |
| 2,473,035 | 6/1949 | Meade et al. | 239/380 X |
| 2,526,220 | 10/1950 | Goddard . | |
| 2,878,066 | 3/1959 | Erwin | 239/99 X |
| 3,044,711 | 7/1962 | Douglas et al. | 239/101 X |
| 3,220,653 | 11/1965 | Waldrum | 239/380 X |
| 3,924,805 | 12/1975 | Nebeker et al. . | |
| 4,190,207 | 2/1980 | Fienhold et al. | 239/381 |
| 4,204,495 | 5/1980 | Wyner | 118/300 |

*Primary Examiner*—Andres Kashnikow
*Assistant Examiner*—Kevin Weldon
*Attorney, Agent, or Firm*—Daniel H. Kane

[57] ABSTRACT

Method steps for production of substantially uniform size droplets from a flow of liquid include forming the flow of liquid, periodically modulating the momentum of the flow of liquid in the flow direction at controlled frequency, generating a cross flow direction component of momentum and modulation of the cross flow momentum of liquid at substantially the same frequency and phase as the modulation of flow direction momentum, and spraying the so formed modulated flow through a first nozzle outlet to form a desired spray configuration. A second modulated flow through a second nozzle outlet is formed according to the same steps, and the first and second modulated flows impinge upon each other generating a liquid sheet. Nozzle apparatus for modulating each flow includes rotating valving plates interposed in the annular flow of liquid. The plates are formed with radial slots. Rotation of the rotating plates is separably controlled at differential angular velocities for a selected modulating frequency to achieve the target droplet size and production rate for a given flow. The counter rotating plates are spaced to achieve a desired amplitude of modulation in the flow direction, and the angular velocity of the downstream rotating plate is controlled to achieve the desired amplitude of modulation of momentum in the cross flow direction. Amplitude of modulation is set according to liquid viscosity.

36 Claims, 4 Drawing Sheets

HIGH FLOW RATE NOZZLE SYSTEM WITH PRODUCTION OF UNIFORM SIZE DROPLETS

The U.S. has rights in this invention by reason of research and development support under Department of Energy Droplet Project Grant No. AC/02-83CE40626.

TECHNICAL FIELD

This invention is directed to a new high flow rate, high throughput, or high production nozzle which generates uniform size droplets within a small range around a selected target droplet size. The invention is intended for use in applications requiring a high volume flow rate or throughput of liquid with spray production of droplets where the droplet size must be controlled as for example in spraying of process liquid into a recovery boiler.

BACKGROUND ART

In the pulp and paper industry the so-called black liquor is sprayed into a recovery boiler for recovery of the spent chemicals used in Kraft process pulping or delignification and for recovery of energy from waste organics also contained in the black liquor. The droplet size of black liquor sprayed in the Kraft pulping process recovery boiler is critical. If the droplets are too large all of the water does not evaporate and water may enter the char bed in the lower part of the furnace and shift the char bed chemistry in an undesirable direction, e.g. toward production of hydrogen sulphide. If the droplet size is too small the residual sulfur and sodium may coat the tubes at the top of the furnace and have to be removed with steam. At the critical size range the residual inorganic residues fall to the bottom of the furnace where they can be recovered. Ordered droplet control within the critical size range greatly improves the efficiency and reduces the cost of Kraft process chemical and energy recovery.

In high throughput or high flow rate nozzles control of droplet size is difficult because of the turbulent and chaotic flow conditions in the nozzle. At these high production rates the surface tension effects of the liquid are overwhelmed by shear forces resulting in chaotic droplet formation in conventional nozzles. This is typical in power boiler nozzles where spray atomization is used for efficient fuel combustion. There is no concern for ordered droplet formation or droplet uniformity. The objective of spray atomization is to achieve the largest possible liquid surface area and it is typically used in fuel combustion and fuel injection.

The present invention is also to be contrasted with nozzle applications requiring low flow rates in gentle flow environments where surface tension may be used to control droplet size. Ordered droplet production and uniform size control of spray from nozzles may be important in a variety of applications, for example, some types of spray drying, agricultural spraying, ink jet printing, cooling tower spray cooling, and freeze drying. Some of these applications, however, are not concerned with high throughput and high volume flow rate, and low flow rates may facilitate control of droplet size.

OBJECTS OF THE INVENTION

It is therefore an object of the present invention to provide a high volume rate of flow, high throughput nozzle system which achieves ordered droplet formation within a narrow range of selected target droplet size.

Another object of the invention is to provide a nozzle system for production of uniform size droplets in a high flow rate environment with variable control over the selected target droplet size and the droplet production rate. The nozzle system is also adjustable for accommodating liquids of different viscosities.

A further object of the invention is to provide an ordered droplet production nozzle system particularly applicable for spraying process liquid in a desired configuration into a recovery boiler to improve efficiency of process chemical recovery. The invention may be used in any application requiring a high production rate of controlled and uniform size droplets.

DISCLOSURE OF THE INVENTION

In order to accomplish these results the present invention provides a method for production of substantially uniform size droplets from a flow of liquid by forming the flow of liquid into a desired flow configuration and periodically modulating the momentum of the flow of liquid in the flow direction at controlled frequency. The invention further contemplates generating a cross flow direction component of momentum and modulation of the flow of liquid at substantially the same frequency and phase as the modulation of momentum in the flow direction. The modulated flow is sprayed through a first nozzle outlet to form a desired spray configuration.

In order to form a liquid fan sheet, a final step of the invention may take the form of impinging the modulated flow on a selected impingement surface. This impingement surface may be a splash plate or preferably a second liquid flow.

In the preferred example embodiment the invention provides the further steps of forming a second modulated flow through a second nozzle outlet according to the same steps used in forming the first modulated flow, and spraying the so formed second modulated flow through the second nozzle outlet. The first and second modulated flows are directed for impinging upon each other and generating a liquid sheet. In the preferred examples the first and second modulated flows are arranged to impinge upon each other with the respective axes in the flow direction at an angle in the preferred range of approximately 50° to 70° with respect to each other. The angle of impingement may extend over a broader range, however, and the particular angle of impingement is selected to achieve a desired sheet fan configuration ranging, for example, from strongly elliptical to circular as the angle increases to approximately 70°. The liquid sheet fan is typically developed in the horizontal plane and the angle of impingement may be viewed as two half angles of each nozzle to the horizontal in the preferred range of 25° to 35°.

The parameters of the first and second modulated flows are selected and varied as follows. The modulations of the first and second modulated flows are selected to be at approximately the same frequency. The impingement of the first and second modulated flows is generally arranged with the modulations out of phase with respect to each other and in the best mode of the invention approximately 180° out of phase with respect to each other. However, the phase relationship may vary. The two orthogonal components of flow direction and cross flow direction momentum of the single liquid stream or of each of the two impinging liquid streams, and the modulation imparted to each of the components of flow momentum coact together to achieve the ordered droplet formation according to the invention.

The frequency of modulation of the components of momentum in the flow direction and cross flow direction in the case of a single flow of liquid will be substantially the same. In the case of two impinging modulated flows the respective modulations of the components of flow direction and cross flow direction momentum of both the first and second modulated flows are also at approximately the same frequency. A feature and advantage of this nozzle system configuration and frequency parameter selection is that uniform size droplets are produced within a small range around the selected target droplet size. Furthermore, the selected or target droplet size may be varied according to the frequency of modulation selected for the various components of flow momentum of the single or multiple impinging liquid streams.

The invention also provides the steps of varying the amplitude of modulation or percentage modulation of either or both the modulation in the flow direction and modulation in the cross flow direction of the modulated liquid flow according to the viscosity of the liquid. According to another variable the liquid flow rate through the nozzle system is controlled to achieve the desired droplet production rate. The liquid flow rate and frequency of modulation are coordinated to produce the desired target droplet size.

The invention also provides the nozzle system apparatus for carrying out the method of high volume rate of flow ordered droplet formation within a narrower range of target droplet size and for control of the modulated flow parameters to achieve the desired spray characteristics. Each nozzle is preferably formed with an annular passageway for forming the flow of liquid into an annular flow, for example cylindrical or conical. Upstream and downstream differentially rotating plates or surfaces are positioned or interposed in the annular flow of liquid. The rotating plates are formed with openings such as radial slots around at least a portion of the periphery of the plate surfaces. Motors are provided for separately rotating and controlling the angular velocity of rotation of the upstream and downstream counter rotating or differentially rotating plate surfaces. A nozzle outlet is provided for spraying the modulated flow of liquid passing through the differentially rotating plates from the annular passageway.

According to the best mode of the invention a second nozzle is provided, constructed and arranged with the same configuration of elements as the first nozzle for generating a second modulated flow. The first and second nozzles are oriented at an angle with respect to each other with the axes intersecting for impingement of the first and second modulated flows, producing a liquid sheet spray. The resulting spray configuration of the impinging streams is generally a liquid fan sheet emerging along a substantially common horizontal elevation or plane for example for spraying of process liquid into a recovery boiler.

The differentially rotating plates or plate surfaces for each nozzle may be for example circular, cylindrical or conical and are matched for close spacing and rotation at high speeds. The differentially rotating plate surfaces produce a relatively high frequency open and close valving action which valves, pulses, or modulates the quantity of flow or flow momentum in the flow direction. The frequency of this modulation is equal to the product of the effective or differential RPM (or, more conveniently, revolutions per second, RPS) of the plates with respect to each other times the number of radial slots around the plate.

The down stream rotating plate imparts to the annular stream the cross flow component of momentum. This cross flow component of momentum may be imparted by the radial slots of the downstream rotating plate. The cross flow momentum may be modified by vanes projecting from the openings or slots on the downstream side of the rotating plate, altering cross flow momentum in the cross flow direction. Modulation of the cross flow direction momentum results from the same valving action of the counter rotating plates which causes flow direction modulation and is therefore at the same frequency.

The amplitude of modulation of each annular flow of liquid in the flow direction is determined by the spacing between the respective upstream and downstream plate surfaces, and this spacing may be varied to vary and control the amplitude of momentum modulation in the flow direction according to the viscosity of the liquid. For example, higher viscosity higher centipoise liquids may require a greater percentage of amplitude modulation achieved with closer spacing of the plates to optimize nozzle performance while for desired nozzle performance with lower viscosity liquids a lower percentage of amplitude modulation achieved with greater spacing of the plates may be used.

The amplitude of modulation of the cross flow component of momentum of each flow is controlled by varying the angular velocity of the downstream rotating plate which imparts the cross flow momentum to the annular flow and modulates the cross flow momentum. For example, the angular velocity of the downstream plate is first set to achieve a desired cross flow component of momentum. The angular velocity and direction of rotation of the upstream plate is then selected to achieve the desired frequency of modulation. For higher frequency the upstream plate rotates in the opposite direction from the downstream plate and the upstream and downstream plates are counter rotating. For lesser frequencies, the upstream plate may rotate in the same direction but at differential angular velocities with respect to the downstream plate to achieve a desired frequency of modulation of flow direction momentum and cross flow direction momentum.

In the preferred embodiment of the nozzle system where first and second nozzles direct first and second modulated flows at an angle for impingement to produce a liquid fan sheet, a first drive motor and first timing belt operatively couple and drive the upstream rotating plates of the first and second nozzles at the same angular velocity. A second drive motor and second timing belt operatively couple and drive the downstream rotating plates of the first and second nozzles at the same angular velocity but at a differential velocity of rotation from the upstream rotating plates. The rate of drive rotation of each of the motors may be separately varied and controlled for separately controlling the angular velocity of the upstream rotating plates and the downstream rotating plates. Thus, the downstream rotating plates may be independently controlled to set the amplitude of cross flow direction momentum modulation. The frequency of modulation in the flow direction is set by the relative or differential angular velocity between the counter rotating upstream and downstream plates and the number or radial slots around the plate surface.

Typically the modulations of momentum introduced in the flow direction and cross flow direction of the first nozzle are out of phase with the respective modulations introduced in the second nozzle. According to the best mode contemplated by the invention the phase relationship of the plates are set so that the respective modulations are approximately 180° out of phase. A feature of this out of phase relationship is that it produces sinusoidal variation of the composite liquid fan following impingement. The liquid sheet fan waves, vibrates, or flaps as a result of the impingement of the two modulating flows substantially 180° out of phase. This flapping sheet fan of liquid produces arc filaments of liquid expanding in the radial or flow direction from the nozzle. It is believed that the modulated cross flow momentum and centrifugal force fragment the filaments in the cross flow direction into droplets of controlled size.

The phase relationship between the modulations of the two liquid streams from the two nozzles is set by the phase relationships of the two upstream plates on their respective drive shafts. The upstream plates are threaded on the end of their respective drive shafts. The rotational position may be varied over the range of angular distance, for example between two slots for setting relative phase difference between the two upstream plates from 0° to 180°. The rotational phase position of each of the upstream plates is then locked into position with a locking ring or nut on the same threads. The established phase relationship is then maintained by the notched timing belt of the upstream plates which assures the same timing and phase.

The cross flow momentum or swirl introduced into the annular flow of liquid produces divergence of the annular flow as it exits the nozzle. According to the invention this divergence and centrifugal force outward of the annular flow of liquid may be reduced by applying a vacuum at the center of the nozzle outlet to restrain divergence. Thus, the vacuum may be applied at the center of each nozzle outlet to reduce divergence in the pre-impingement space downstream from the nozzles and before impingement. Impingement resolves the flow direction and cross flow direction modulations into approximately polar or curvilinear components in the plane of the fan.

The phenomenon of uniform liquid droplet size formation according to the invention may be described in the preferred example as follows. The two impinging modulated flows form and combine the respective "three dimensional" streams into a merged "two dimensional" liquid sheet fan diverging outwardly and radially from the intersection of the axes of the two nozzles in an elliptical or circular plane configuration. The flow direction momentum modulation "bunches" the liquid of the fan into liquid filaments in the configuration of elliptical or circular arcs spreading or diverging radially outwardly in the plane of the fan from the intersection of the impinging modulated flows. The flow direction momentum modulation may therefore be viewed as converting the "two dimensional" fan into "one dimensional" but curved arc filaments. The residual cross flow momentum modulation bunches the "one dimensional" filaments along the arcs of the filaments into "zero dimensional" droplets. Actually of course droplets are formed of finite dimension and of tightly controlled uniform droplet size around the target droplet size. It is noted that the momentum modulations from the two flows presented out of phase introduce vibratory flopping and twisting motions in the fan which facilitate the uniform droplet production.

A feature of the invention is that the final spray configuration from the nozzle system may be in any desired configuration for a particular application. The combined flow direction modulation and cross flow direction modulation of the same frequency and phase imparted to the annular flow of liquid before exiting the nozzle assures the ordered droplet formation within a small range around a target droplet size according to the invention. A fan, conical, or other sheet configuration may be formed at the nozzle outlet for the desired application. A single nozzle may be used with or without impingement. Impingement on a splash plate or against another liquid stream may be used to achieve a desired sheet fan configuration. The beneficial effects according to the invention are optimized in the preferred arrangement of two impinging modulated flows with the parameters of frequency and phase of the respective flow direction and cross flow direction modulations selected according to the invention.

Other objects, features, and advantages of the invention are apparent in the following specification and accompanying drawings.

DESCRIPTION OF PREFERRED EXAMPLE EMBODIMENTS AND BEST MODE OF THE INVENTION

Figure 1:
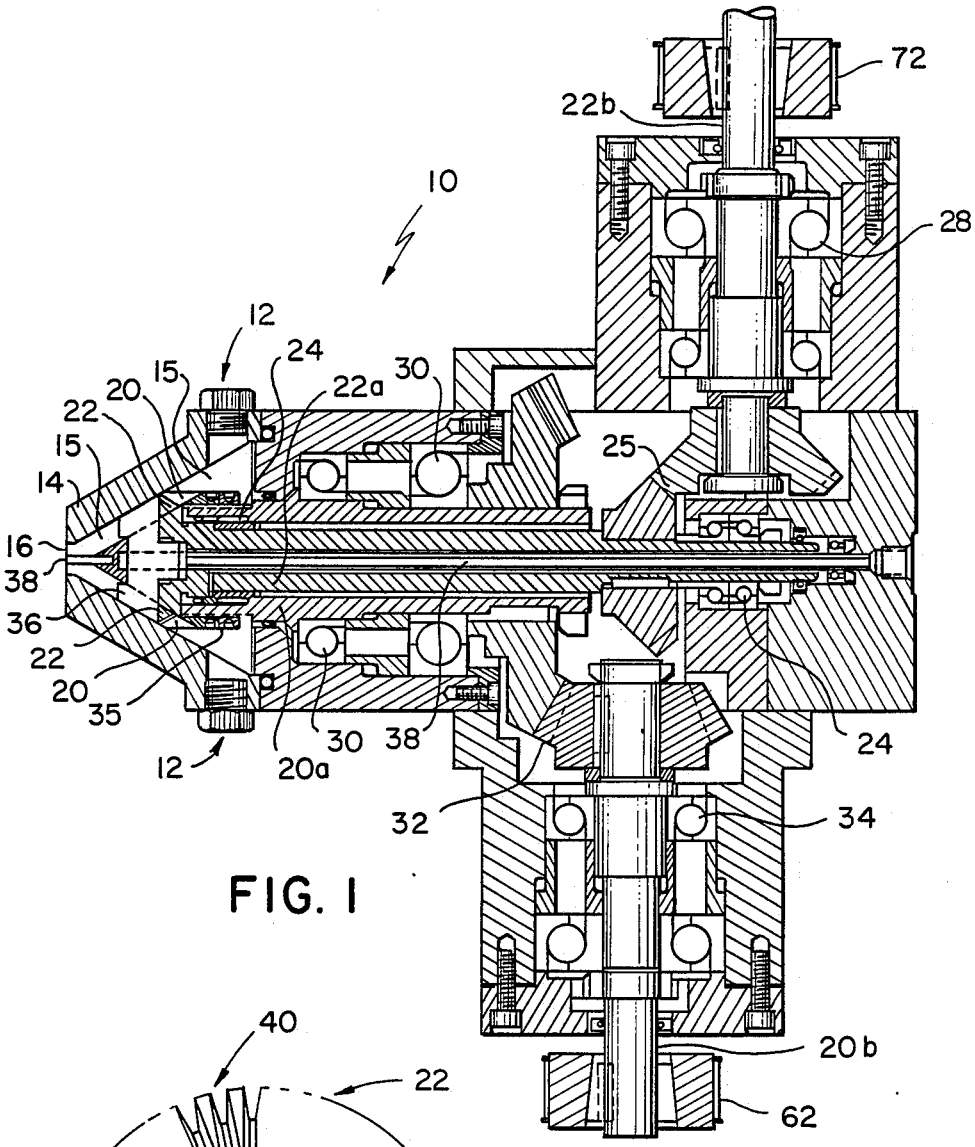
FIG. 1 is a side cross sectional view of a high flow rate uniform droplet production nozzle according to the invention.

A nozzle 10 constructed according to the invention is illustrated in FIG. 1 with liquid inlets 12 for receiving liquid for spray production of droplets, a nozzle cone 14 with a conical annulus passageway 15 forming the liquid into an annular flow, and nozzle outlet 16 for spraying and delivering a jet stream of the liquid. Interposed in the annular passageway 15 of the nozzle cone 14 are the rotating plates, upstream rotating plate or valving plate 20 and downstream rotating plate or valving plate 22.

The downstream valving plate 22 is integrally connected to a central drive shaft **22*a* mounted for rotation within the nozzle body on bearings 24. The central drive shaft 22*a* is coupled through right angle drive coupling 25 to a right angle drive shaft 22*b* extending from the side of the nozzle assembly 10 for coupling to a first drive motor for driving the downstream rotating plate 22 as hereafter described. The downstream rotating plate right angle drive shaft 22*b* is mounted for rotation on bearings 28**.

The upstream valving plate 20 is connected to the outer concentric drive shaft 20*a* mounted for rotation in the nozzle body on bearings 30. The upstream valving plate outer concentric drive shaft 20*a* is coupled through right angle drive coupling 32 to a second right angle drive shaft 20*b* extending from the other side of the nozzle assembly 10. Drive shaft 20*b* is mounted for rotation in the nozzle body on bearings 34. The upstream rotating plate right angle drive shaft 20*b* extends from the nozzle assembly 10 on the side opposite the first right angle drive shaft 22*b* for coupling to a second drive motor for driving and controlling rotation of the upstream rotating plate 20 independently from the downstream rotating plate.

The downstream valving plate 22 and central drive shaft 22*a* form an integral component which maintains the same lateral position within the nozzle body. The spacing between the upstream valving plate 20 and downstream valving plate 22 is controlled by adjustment of the upstream valving plate 20. The upstream valving plate 20 is threaded onto the end of the outer concentric drive shaft 20*a* permitting fore and aft adjustment and positioning of the upstream plate 20 on concentric drive shaft 20*a* thereby varying the spacing between the counter rotating plates 20 and 22. The upstream plate 20 is locked into the desired position on concentric drive shaft 20*a* by a locking collar 35. The relative rotational positions of the upstream plates on the upstream drive shafts of two nozzles oriented for impingement of the respective modulated streams sets the relative phase between the modulations of the two streams as hereafter described.

Optional features of the nozzle include downstream plate slot extensions or vanes 36. The vanes 36 are rigidly connected to and extend from radial slots formed in the downstream plate 22 to modify the magnitude of the swirl or cross flow component of momentum imparted to the annular liquid flow by rotation of the downstream plate 22. As hereafter described the depth of the radial slot formed in the downstream rotating plate 22 may be sufficient to impart the desired level of cross flow momentum or swirl to the annular flow of liquid. If not, the slot extensions or vanes 36 are added to the downstream rotating plate 22 and drive shaft 22*a* to modify the swirl.

Another optional feature of the valve 10 is a central vacuum channel 38 for applying a vacuum to the, center of the liquid jet stream emerging from the nozzle cone 14 at the nozzle outlet 16. Such a vacuum can be applied to restrain and provide further control over the outward divergence of the liquid jet stream due to the cross flow momentum, swirl and centrifugal force imparted to the liquid flow by rotating downstream plate 22. The function of the vacuum is to reduce divergence of the stream emanating from the nozzle in the pre-impingement space, that is prior to impingement for example with a second modulated flow.

Figure 2:
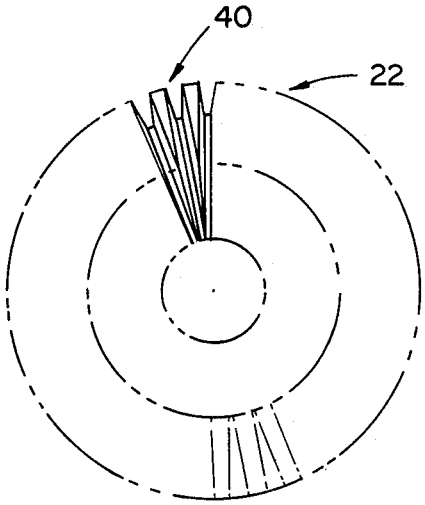
FIG. 2 is a detailed plan view of one of two counter-rotating plates for modulating the flow of liquid through the nozzle.

A detailed plan view of one of the rotating plates, for example downstream plate 22, is illustrated in FIG. 2. Referring to both FIGS. 1 and 2, it is apparent that the rotating plate is circular in cross section and in this example with a conical taper in the depth direction. The plate is formed with radial slots 40 equally distributed or spaced around the plate 22. Only a few of the equally spaced slots are shown by way of example. The slots 40 are preferably formed through the plate with an equal width along the length of each slot although this is not a necessary feature of the invention. With equal slot width along the length of each slot, the spacing between slots therefore increases with radial distance from the center of the rotating plate. The radial slots are formed around the periphery of the plate to span across the annular passageway 15 in the cone 14 of the nozzle 10.

In the example of FIG. 2 the number of slots formed around the periphery of the plate is approximately 36 although all of the slots are not shown. The upstream plate is formed with the same general configuration. If the number of radial slots formed in each counter rotating plate is n and the differential angular velocity between the two counter rotating plates in revolutions or rotations per second is R, then the frequency of modulation F at any particular fixed radial position is given by $F = n \times R$, where F is specified by cycles per second or hertz. The droplet production rate is proportional to $F^2$, a rate higher than can be achieved generally with mechanical oscillation.

Figure 3:
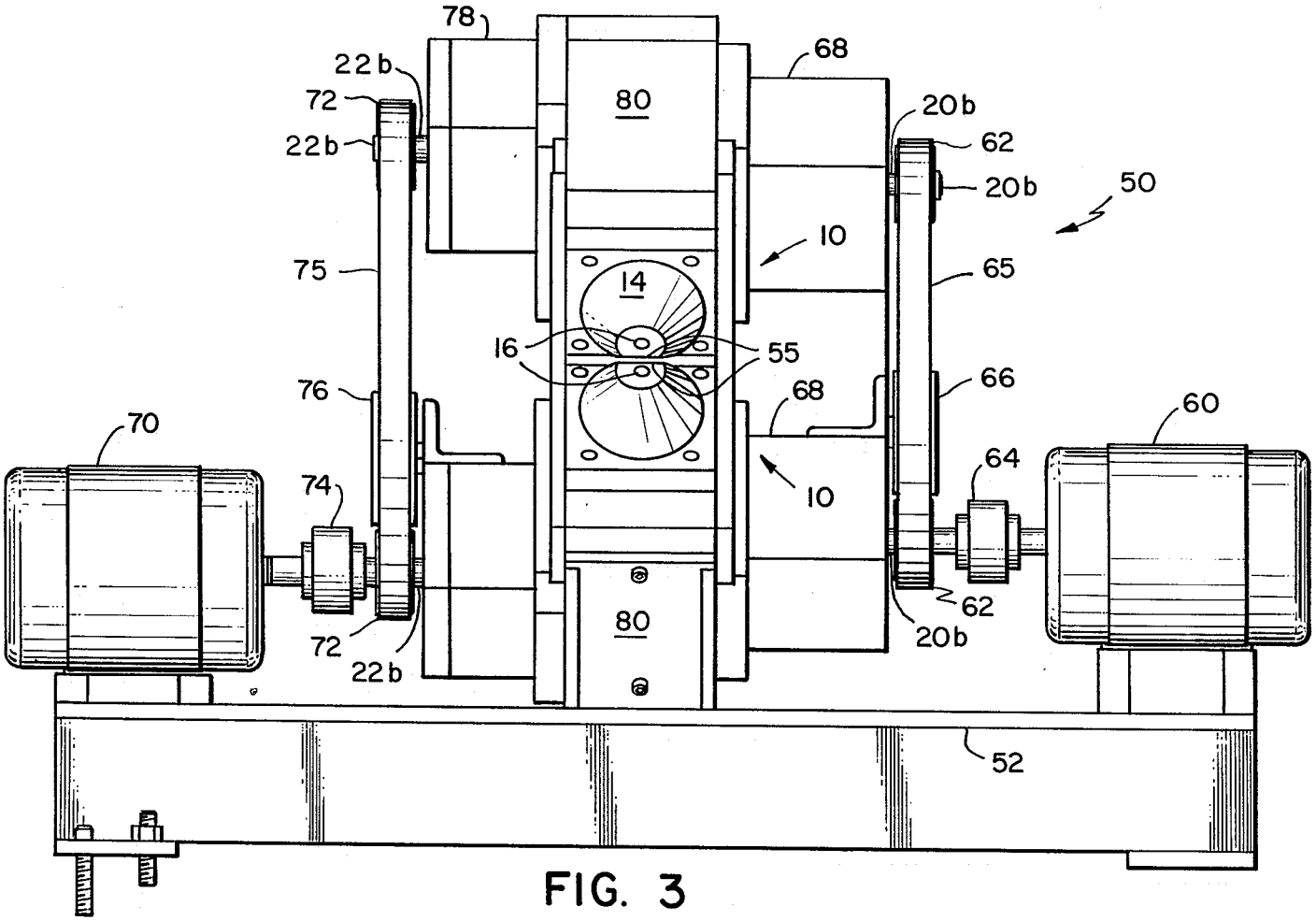
FIG. 3 is a front elevation view of a nozzle system incorporating two of the nozzles oriented for impingement of the first and second modulated flows to form a liquid sheet fan.
Figure 4:
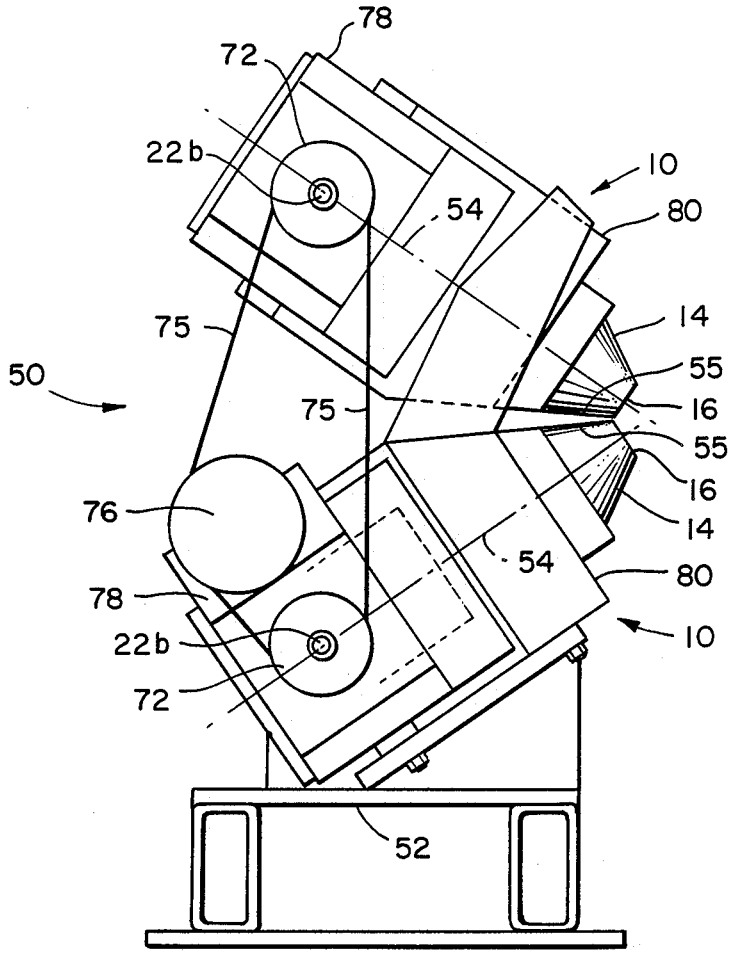
FIG. 4 is a side view of the nozzle system with one of the drive motors removed showing the orientation of the two nozzles.

A nozzle system or nozzle assembly 50 incorporating two nozzles 10 as described with reference to FIG. 1 is illustrated in FIGS. 3 and 4. The nozzles 10 are mounted on a base 52 and oriented with the center axes 54 of the respective nozzles intersecting. Each nozzle is oriented at a half angle or angle with respect to the horizontal plane of for example 35° with a total angle of 70° between the intersecting axes of the two nozzles. The nozzle cones 14 are formed with a flat edge and flat surface 55 on adjacent sides of the respective nozzle cones for juxtaposition of the nozzle outlets 16 immediately adjacent to each other. As a result the modulated liquid flow jets emerging from the respective nozzle outlets 16 impinge at substantially the angle of the axes of approximately 35°. The preferred angular range of impingement for the first and second modulated flows is in the range of approximately 25° to 35° although other angles may of course be used to achieve desired composite spray configurations.

As shown in FIG. 3 a first drive motor 60 is provided for driving simultaneously the two upstream rotating plates 20 of the respective nozzles 10. Drive motor 60 is coupled for driving the upstream plate drive rollers or pulleys 62 through motor coupling 64 and timing belt 65. A tension pulley 66 is also provided for adjusting the tension on timing belt 65.

A similar arrangement is provided on the opposite side of the nozzle system 50 with a second drive motor 70 for simultaneously driving and rotating the respective downstream rotating plates 22 of the two nozzle assemblies 10. The second drive motor 70 drives the drive rollers or pulleys 72 for the respective downstream rotating plates 22 through the second drive motor coupling 74 and second timing belt 75. A second tension pulley 76 is also provided for adjusting the tension on timing belt 75.

Correlating FIGS. 3 and 4 with FIG. 1, the nozzle housing portions 68 house the respective upstream plate right angle drive shafts 20*b* and bearings 34. The nozzle housing portions 78 house the respective downstream plate right angle drive shafts 22*b* and bearings 28. The central housing portions 80 contain the downstream plate central drive shaft 22*a* with bearings 24 and the upstream plate outer concentric drive shaft 20*a* with bearings 30. The right angle drive couplings 25 and 32 leading to the respective right angle drive shafts 22*b* and 20*b* are also contained in the respective housing portions.

For applications in spraying black liquor from the Kraft pulping process into a recovery boiler, the viscosity of the black liquor is typically in the range of 100 to 300 centipoise. For the range of viscosity to be encountered, the spacing between the upstream and downstream counter rotating plates is typically in the range of from 2–5 mils (0.005–0.013 cm) to 10–20 mils (0.025–0.05 cm). By way of example, the slotted plates may be formed with 24 to 36 radial slots equally spaced around the plate. The differential angular velocity between the counter rotating or differentially rotating plates is in the order of 2000–3000 RPM for example 2,150 RPM. With final jet streams from the nozzles in the order of one half inch (1.25 cm) to three quarter inch (1.9 cm) in diameter, and flow rates of for example 40 feet per second (480 inches per second) (12.2 meters per second), the filament production rate for target droplet size of for example 2.0 mm may be in the order of 859 per second (51,525 per minute) to 1,288 per second (77,288 per minute) and the droplet production rate is approximately the square of the filament production rate. A typical volume flow rate for such a recovery boiler nozzle is 60 gallons per minute (GPM). By adjusting the differential angular velocity the frequency of modulation may be selected to achieve the desired droplet size for optimum efficiency in chemical recovery boiler operation which is believed to be specified as a target size within the diameter range of for example 1 mm to 5 mm. Close control is achieved according to the method and apparatus of the invention within a tight range around the selected target droplet size.

Parameters can initially be established for the specified target droplet size by viewing produced droplets in real time with high speed video and strobe light synchronized with the modulating frequency. In operation, parameters selected and established for nozzle operation, for example in a recovery boiler or furnace, are determined on the basis of performance of the furnace. Selected nozzle operating parameters depend upon temperature distribution in the furnace, reduction efficiency at the bottom of the furnace, carry over to the top of the furnace, heat transfer in heat exchange tubes etc. Nozzle modulating frequencies, amplitudes, and volume throughput are selected to maximize efficiency and recovery. Optimum droplet size between too small and too large is selected based upon furnace performance.

In operation of the nozzle system of FIGS. 3 and 4, the angle of intersection between the axes of the two nozzles is first selected. The timing belt is set in place and the tension properly adjusted. Finally, the phase relationship between the respective modulations from the two nozzles is set by the relative rotational positions of the upstream plates on the respective drive shafts. The plates are locked into the respective phase positions by lock rings on the respective drive shafts. For example, in a plate with 36 equally spaced slots, the angular distance or width covered by a single slot and land is 10°. Therefore, a 5° rotation of the plate represents a 180° change of phase.

Figure 5:
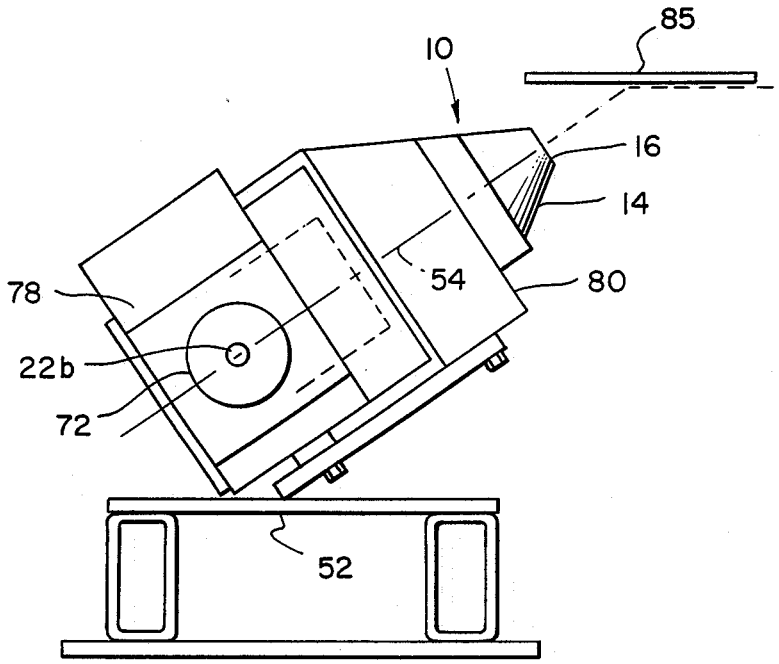
FIG. 5 is a side view of another nozzle system with a single nozzle assembly oriented for impingement of the modulated flow on a splash plate.

An alternative nozzle system incorporating a single nozzle assembly 10 oriented for impingement of the modulated flow from the nozzle outlet 16 against a splash plate 85 is illustrated in FIG. 5. The nozzle assembly 10 is of the type illustrated in FIG. 1 and is similar to the lower nozzle assembly of FIG. 4 with similar elements designated by the same reference numerals. The upper nozzle assembly has been replaced by splash plate 85 oriented in this example for spray production of droplets in a substantially horizontal sheet or fan.

While the invention has been described with reference to particular example embodiments it is intended to cover all modifications and equivalents within the scope of the following claims.

I claim:

1. A method for production of substantially uniform size droplets from a flow of liquid flowing through a first nozzle in the axial flow direction of the nozzle comprising:

forming the flow of liquid into a first annular flow of liquid;

periodically modulating the momentum of the annular flow of liquid in the axial flow direction at controlled frequency;

imparting a cross flow direction component of momentum in the form of a swirl to the annular flow of liquid thereby forming a first modulated flow of liquid having axial flow direction and cross flow direction components of momentum;

and spraying the so formed first modulated flow through a first nozzle outlet to form a desired spray configuration.

2. The method of claim 1 further comprising the step of impinging the first modulated flow on a splash plate to form a modulated liquid fan sheet having components of momentum in the flow direction and cross flow direction.

3. The method of claim 1 further comprising the step of forming a second modulated flow through a second nozzle outlet according to the steps of claim 1, spraying the so formed second modulated flow through the second nozzle outlet, and impinging the first and second modulated flows upon each other thereby generating a modulated liquid sheet having components of momentum in the flow direction and cross flow direction.

4. The method of claim 3 wherein the modulations of the first and second modulated flows are at approximately the same frequency.

5. The method of claim 4 wherein the impinging of the first and second modulated flows is arranged with the respective modulations of the first and second modulated flows out of phase with respect to each other.

6. The method of claim 5 wherein the modulations of the respective first and second modulated flows are 30 approximately 180° out of phase with respect to each other.

7. The method of claim 3 wherein the impinging of the first and second modulated flows is arranged so that the respective modulated flows impinge upon each other with the respective axes in the flow direction at an angle in the range of approximately 50° to 70°.

8. The method of claim 3 wherein the impinging of the first and second modulated flows is arranged so that the impinging modulated flows form a liquid fan sheet.

9. The method of claim 1 further comprising the step of impinging the modulated flow on a second liquid flow to form a liquid sheet spray.

10. The method of claim 1 further comprising the step of varying the amplitude of modulation in the flow direction according to the viscosity of the liquid.

11. The method of claim 1 further comprising the step of selecting the frequency of the modulation of momentum in the flow direction according to the selected target droplet size.

12. The method of claim 11 further comprising the step of controlling the liquid flow rate to achieve the desired droplet production rate and droplet size.

13. The method of claim 1 wherein the steps of modulating the momentum of the annular flow of liquid in the flow direction comprises:

interposing rotating plates in the annular flow of liquid, said plates being formed with slots around at least a peripheral portion of the plate surfaces;

rotating the rotating plate surfaces at differential angular velocities selected to produce a desired droplet production rate and droplet size;

spacing the rotating plates a distance from each other to achieve a desired amplitude of modulation of momentum in the flow direction;

and controlling the angular velocity of the downstream rotating plate for imparting the desired component of momentum in the cross flow direction in the form of a swirl of the annular flow.

14. The method of claim 3 further comprising the step of varying the amplitude of modulation in the axial flow direction in each of the respective first and second modulated flows according to the viscosity of the liquid.

15. The method of claim 3 further comprising the step of selecting the frequency of the modulation of momentum in the axial flow direction in each of the respective first and second modulated flows according to the selected target droplet size.

16. The method of claim 15 further comprising the step of controlling the liquid flow rate to achieve the desired droplet production rate and droplet size.

17. The method of claim 3 wherein the steps of modulating the momentum of the annular flow of liquid in the axial flow direction in each of the respective first and second modulated flows comprises:

interposing rotating plates in the respective annular flow of liquid, said plates being formed with slots around at least a peripheral portion of the plate surfaces;

rotating the rotating plate surfaces at differential angular velocities selected to produce a desired droplet production rate and droplet size;

spacing the rotating plates a distance from each other to achieve a desired amplitude of modulation of momentum in the flow direction;

and controlling the angular velocity of the downstream rotating plate for imparting the desired component of momentum in the form of a swirl of the respective annular flow of liquid in the cross flow direction.

18. A method for production of substantially uniform size droplets from a flow of liquid comprising:

forming the flow of liquid into a first annular flow;

periodically modulating the momentum of the first annular flow of liquid in the flow direction at controlled frequency by interposing rotating plate surfaces in the annular flow of liquid, said plates being formed with openings around at least a portion of said plate surfaces, and rotating the rotating plate surfaces relative to each other at differential angular velocities selected to produce said controlled frequency;

generating a cross flow direction component of momentum of the first annular flow of liquid by rotating the downstream rotating plate and controlling the angular velocity of the downstream rotating plate for imparting the desired cross flow direction component of momentum in the form of a swirl of the first annular flow thereby forming a first annular modulated flow having components of momentum in the flow direction and cross flow direction; and spraying the so formed first annular modulated flow through a first nozzle outlet to form a desired spray configuration;

forming the flow of liquid into a second annular flow and forming a second annular modulated flow according to the preceding steps, spraying the so formed second annular modulated flow through a second nozzle outlet, and impinging the first and second annular modulated flows upon each other to generate a liquid sheet spray configuration.

19. The method of claim 15 wherein the openings in the rotating plate surfaces comprise radial slots.

20. The method of claim 18 comprising modulating the first and second annular modulated flows at substantially the same frequency.

21. The method of claim 20 wherein the impinging of the first and second annular modulated flows is arranged with the modulations out of phase with respect to each other.

22. The method of claim 21 wherein the modulations of the respective first and second annular modulated flows are approximately 180° out of phase with respect to each other.

23. An improved nozzle system for production of substantially uniform size droplets from a flow of liquid comprising:

a first nozzle having annular passageway means for forming the flow of liquid into an annular flow;

upstream and downstream rotating plates positioned in the annular flow of liquid, said rotating plates being formed with openings around at least a portion of the plates and comprising means for modulating the momentum of the first annular flow of liquid in the flow direction;

first means for separately rotating and controlling the angular velocity of rotation of the upstream rotating plate;

second means for separately rotating and controlling the angular velocity of rotation of the downstream rotating plate, said downstream rotating plate comprising means for imparting a cross flow component of momentum in the cross flow direction to the first annular flow in the form of a swirl thereby forming a first modulated flow having components of momentum in the flow direction and cross flow direction;

and outlet means for spraying the first modulated flow of liquid passing from the annular passageway through the rotating plates.

24. The system of claim 23 further comprising a second nozzle constructed and arranged with the configuration of elements of the first nozzle for generating a second modulated flow, said first and second nozzles being oriented with the axes in the respective flow directions at an angle with respect to each other and directed for impingement of the first and second modulated flows for producing a liquid sheet spray.

25. The system of claim 23 wherein the downstream rotating plate of the pair of rotating plates positioned in the annular flow is formed with vanes projecting from the openings on the downstream side for imparting a desired component of cross flow momentum in the form of a swirl in the cross flow direction.

26. The system of claim 23 further comprising spacing control means for varying the spacing between the upstream and downstream rotating plates for controlling the amplitude of flow direction momentum modulation.

27. The system of claim 24 comprising first drive motor means and first timing belt means operatively coupling and driving the upstream rotating plates of the first and second nozzles at the same angular velocity, and second drive motor means and second timing belt means operatively coupling and driving the downstream rotating plates of the first and second nozzles at the same angular velocity but at a differential angular velocity from the upstream rotating plates.

28. The system of claim 27 wherein the plate positions are set so that the modulations of momentum introduced in the flow direction of the first nozzle are out of phase with the respective modulations introduced in the second nozzle.

29. The system of claim 28 wherein the plate positions are set so that the respective modulations are approximately 180° out of phase.

30. The system of claim 23 wherein the openings formed in the rotating plates are radial slots.

31. The system of claim 30 wherein the radial slots are equally spaced around the plates.

32. An improved nozzle for production of substantially uniform size droplets from a flow of liquid comprising:

first nozzle means comprising annular passageway means for forming the flow of liquid into a first annular flow in an axial flow direction of the nozzle;

upstream and downstream rotating plates positioned in the annular flow of liquid, said rotating plates being formed with openings around at least a portion of the plate surfaces and comprising means for modulating the momentum of the first annular flow in the axial flow direction;

first control means for separately rotating and controlling the angular velocity of rotation of the upstream rotating plate;

second control means operatively coupled for separately rotating and controlling the angular velocity of rotation of the downstream rotating plate said downstream rotating plate comprising means for imparting a cross flow component of momentum in the cross flow direction to the first annular flow in the form of a swirl thereby forming a first modulated flow having components of momentum in the flow direction and cross flow direction;

first outlet means for spraying a first modulated flow of liquid passing from said annular passageway of the first nozzle means through the rotating plates;

second nozzle means constructed and arranged with the same configuration of elements as the first nozzle means for generating a second modulated flow, said first and second nozzle means being oriented at an angle with respect to each other and directed for impingement of the first and second modulated flows for producing a modulated liquid sheet spray having components of momentum in the flow direction and cross flow direction.

33. The nozzle of claim 32 comprising first drive motor means operatively coupling and driving the upstream rotating plates of the first and second nozzle means at the same angular velocity, and second drive motor means and second timing belt means operatively coupling and driving the downstream rotating plates of the first and second nozzle means at the same angular velocity but at a differential angular velocity from the upstream rotating plates.

34. The nozzle of claim 32 wherein the plate positions are set so that the modulations of momentum of the first annular flow introduced in the flow direction of the first nozzle means are out of phase with the respective modulations of momentum of the second annular flow introduced in the second nozzle means.

35. The nozzle of claim 32 wherein the openings around the rotating plates comprise radial slots.

36. The nozzle of claim 35 wherein the downstream rotating plate is formed with sufficient thickness and the radial slots with sufficient depth to impart a cross flow component of momentum to the annular flow of liquid upon rotation of the downstream plate.

* * * * *